US006814148B1

(12) United States Patent
Conner et al.

(10) Patent No.: US 6,814,148 B1
(45) Date of Patent: Nov. 9, 2004

(54) ROTATING JACK PLATE ASSEMBLY

(75) Inventors: Stephen E. Conner, Edmond, OK (US); Joseph Frullo, Oklahoma City, OK (US); Kelly Sikora, Edmond, OK (US)

(73) Assignee: Wood Group ESP, Inc., Oklahoma City, OK (US)

( * ) Notice: Subject to any disclaimer, the term of this patent is extended or adjusted under 35 U.S.C. 154(b) by 0 days.

(21) Appl. No.: 10/295,261

(22) Filed: Nov. 15, 2002

Related U.S. Application Data

(60) Provisional application No. 60/417,079, filed on Oct. 2, 2002.

(51) Int. Cl.[7] ..... E21B 19/00

(52) U.S. Cl. ..... 166/379; 166/77.4; 166/77.51

(58) Field of Search ..... 166/77.51, 77.4, 166/379, 77.1, 78.1

(56) References Cited

U.S. PATENT DOCUMENTS 1,586,923 A * 6/1926 Townsend ..... 166/77.4
3,096,075 A * 7/1963 Brown ..... 254/29 R
4,421,175 A * 12/1983 Boyadjieff et al. ..... 166/383
5,092,399 A * 3/1992 Lang ..... 166/77.53
6,050,340 A 4/2000 Scott
6,213,216 B1 * 4/2001 Rogers ..... 166/380
6,234,253 B1 5/2001 Dallas
6,364,012 B1 4/2002 Adams et al.
6,431,626 B1 8/2002 Bouligny
6,443,241 B1 9/2002 Juhasz et al.

* cited by examiner

*Primary Examiner*—Hoang Dang
(74) *Attorney, Agent, or Firm*—Crowe & Dunlevy, P.C.

(57) ABSTRACT

The present disclosure provides an apparatus and method for positioning a section of a well string. The apparatus includes a base plate and a turntable supported by the base plate. The turntable is preferably configured to rotate with respect to the base plate. At least one jack assembly is supported by the turntable and connects to a load collar, which is configured to support the section of the well string. The rotational position of the section of the well string can be adjusted by rotating the turntable. The vertical position of the section of the well string can be adjusted by raising or lowering the jack assembly.

17 Claims, 4 Drawing Sheets

ROTATING JACK PLATE ASSEMBLY

RELATED APPLICATIONS

This application claims priority to U.S. Provisional Patent Application No. 60/417,079 entitled "Rotating Jack Plate Assembly," filed Oct. 2, 2002, which is incorporated herein by reference.

FIELD OF THE INVENTION

The present invention relates generally to the production of petroleum products from subterranean wells. The present invention more particularly relates to the assembly of downhole equipment before deployment into a subterranean well.

BACKGROUND OF THE INVENTION

A wide variety of downhole equipment is used to assist in the recovery of petroleum fluids from subterranean reservoirs. The term "downhole equipment" refers generally to equipment that is deployed and used in a subterranean well. Electrical submersible pumps, fishing tools and monitoring devices are common examples of downhole equipment. In some instances, a number of separate downhole components are connected as a "well string" and lowered into the well as a single unit.

The traditional well string assembly process is well known within the industry. During a conventional assembly process, the well string, which may consist of pump sections, motor sections, seals and other associated components, must be placed into the well section-by-section. Before a connection can be made, each section must be precisely positioned relative to its mating section.

During assembly, the sections of the well string are vertically suspended through attachment to a crane or derrick. Because each section may be more than thirty feet in length, one section is usually partially lowered into the well before the adjacent section can be attached. After the adjacent section is raised into a position above the lower section, large wrenches are used to rotate the sections into proper alignment. Once properly aligned, the new section is lowered onto the bottom section. In many cases, the adjacent sections are connected through use of abutting flanges and fasteners.

The existing method of assembling a well string is tedious and time consuming. The lateral, rotational and vertical position of the adjacent sections are difficult to control during the assembly process. Such operations are dangerous to the operators and the expensive downhole equipment.

In light of the shortcomings of the existing art, there is a need for an improved apparatus and method for positioning downhole components as they are assembled before deployment. It is to these and other deficiencies in the prior art that the present invention is directed.

SUMMARY OF THE INVENTION

The present invention provides an apparatus and method for positioning a section of a well string. The apparatus includes a base plate and a turntable supported by the base plate. The turntable is preferably configured to rotate with respect to the base plate. At least one jack assembly is supported by the turntable and connects to a load collar, which is configured to support the section of the well string. The rotational position of the section of the well string can be adjusted by rotating the turntable. The vertical position of the section of the well string can be adjusted by raising or lowering the jack assembly.

These and other features and advantages which characterize the present invention will be apparent from a reading of the following detailed description and a review of the associated drawings.

DETAILED DESCRIPTION OF THE PREFERRED EMBODIMENT

Figure 1:
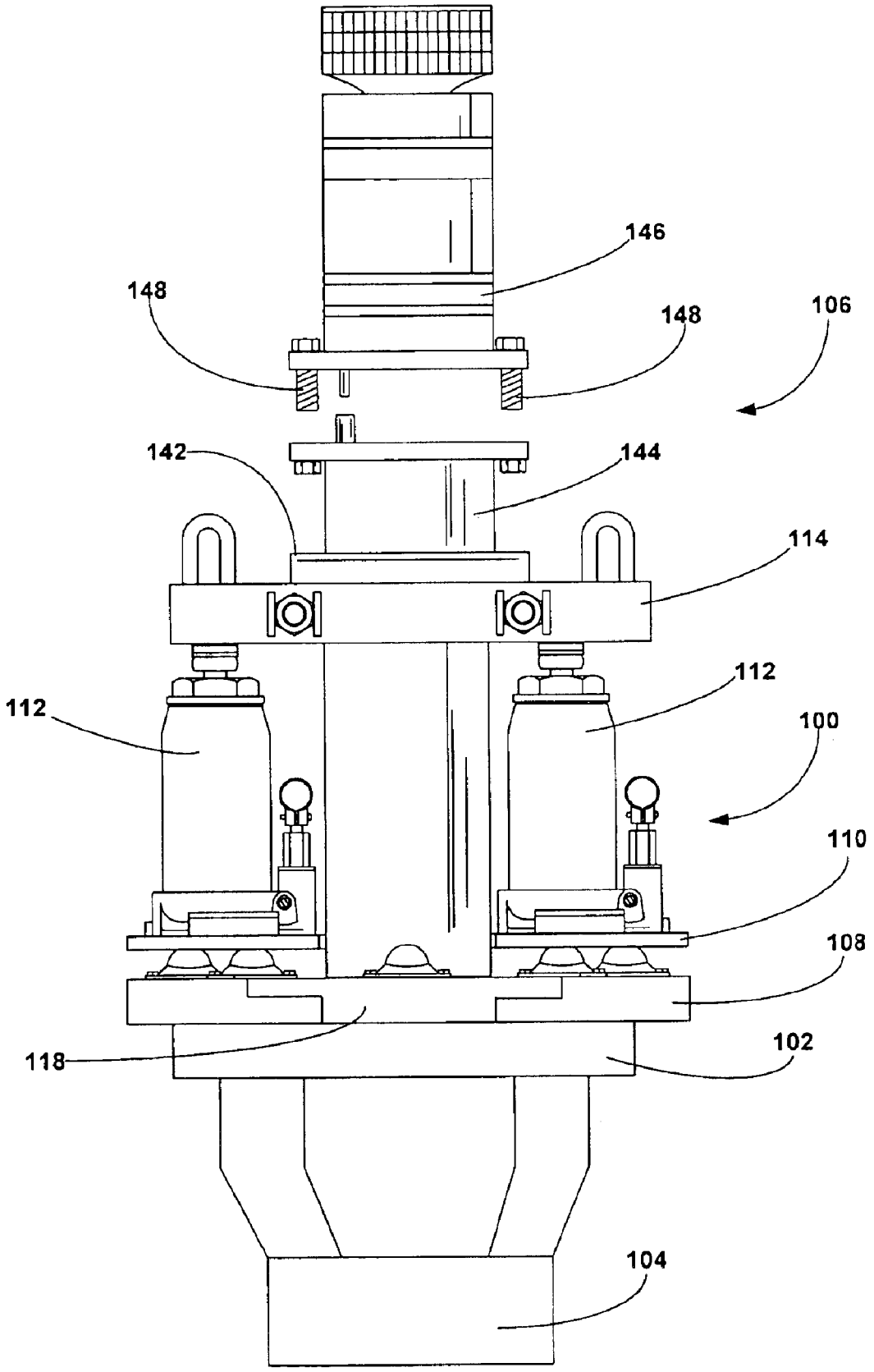
FIG. 1 is a side elevational view of a rotating jack plate assembly constructed in accordance with a preferred embodiment of the present invention positioned adjacent a wellhead during the well string assembly process.

Referring to FIG. 1, shown therein is a rotating jack plate assembly 100 supported by a wellhead 102 of a well 104. The rotating jack plate assembly 100 supports a well string 106 as it is assembled and deployed into the well 104. Although the rotating jack plate assembly 100 is shown positioned directly on the wellhead 102, an intermediate support structure (not shown) may be required in some applications. For example, if a drilling or workover rig is present, the rotating jack plate assembly 100 can be positioned on the rig floor. The rotating jack plate assembly 100 preferably includes a base plate 108, a turntable 110, at least one jack 112 (two are shown in FIG. 1) and a load collar 114.

Figure 2:
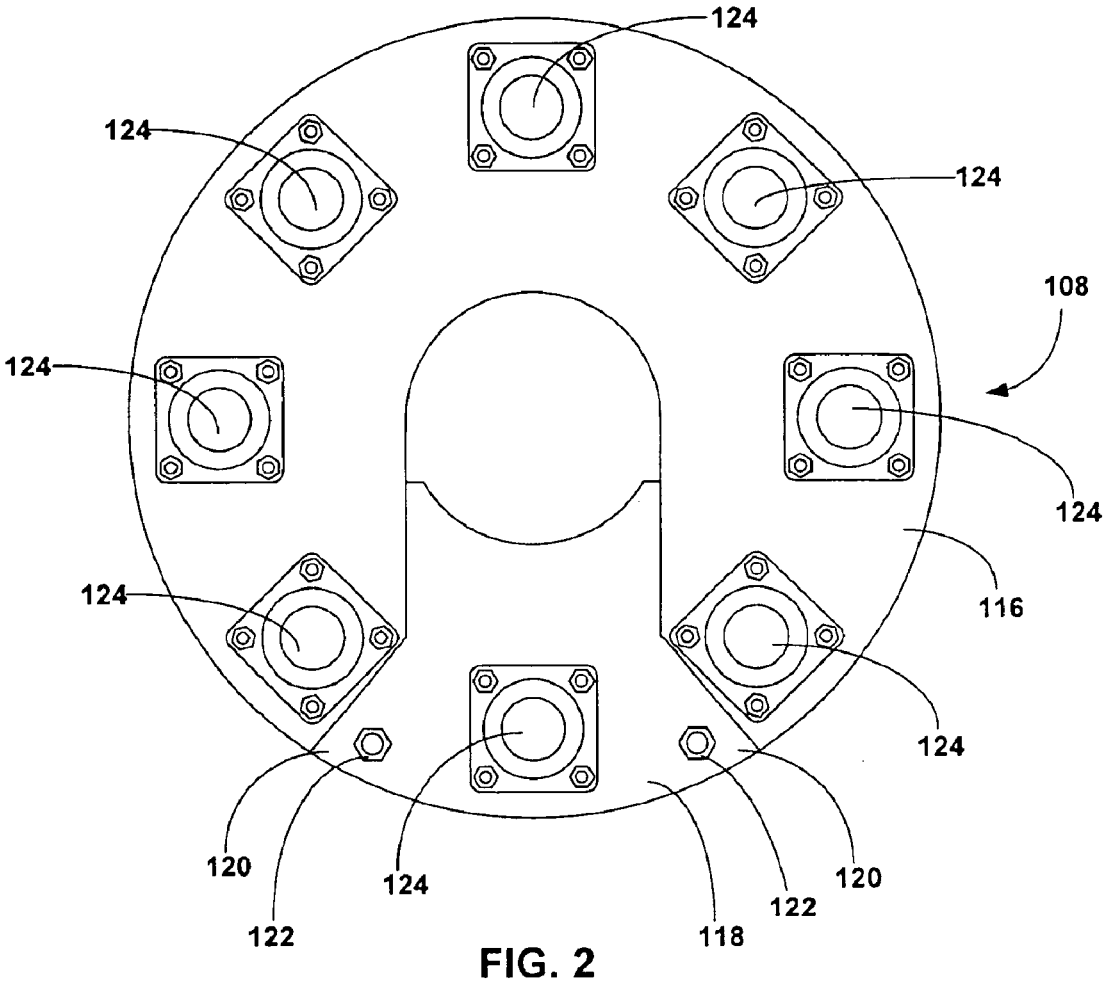
FIG. 2 is a top plan view of the base plate of the rotating jack plate assembly of FIG. 1.
Figure 3:
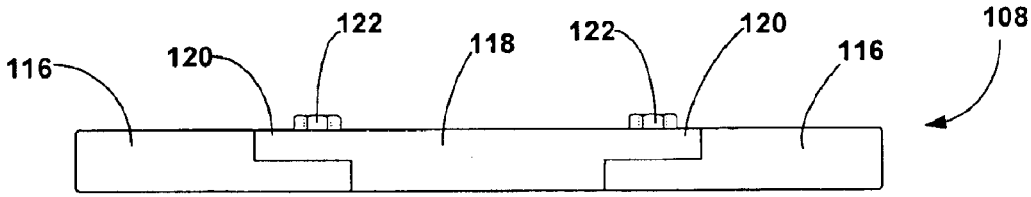
FIG. 3 is a side elevational view of the insert of the base plate of FIG. 2.

Turning to FIGS. 2 and 3, the base plate 108 has a substantially "c-shaped" main member 116 and a removable gate 118. Removing the gate 118 from the base plate 108 permits the lateral introduction or removal of the rotating jack plate assembly 100 onto the well string 106 (not shown in FIGS. 2 and 3). Similarly, removing the gate 118 permits the removal of the main member 116 from the well string 106. When the main member 116 and gate 118 are engaged, the base plate 108 resembles a truncated tube shape. The void in the center of the base plate 108 is preferably sized to admit the well string 106. As such, the inner diameter of the base plate 108 is preferably larger than the outer diameter of the well string 106. The gate 118 can be fixed in position to the main member 116 through use of mating flanges 120 and bolts 122. The main member 116 and removable gate 118 are preferably fabricated from a rigid and durable material, such as steel.

To enable the introduction of different diameters of well string 106, the gate 118 can be partially or fully inserted to form a larger or smaller inner diameter in the base plate 108. Although a "c-shaped" main member 116 and a matching gate 118 have been disclosed as the preferred embodiment, other configurations that allow removal of the base plate 108 from the well string 106 are also encompassed within the scope of the present invention. For example, the base plate 116 could be constructed from two or more arcuate portions hinged together for pivotal separation.

The base plate 108 also includes a plurality of bearings 124 (not shown in FIG. 3). The bearings 124 are preferably ball and socket bearings that are fabricated from a hardened metal or metal alloy. As shown in FIG. 2, each of the bearings 124 is attached to the main member 116 or gate 118 with a plurality of bolts (not separately designated). Although eight bearings 124 are equally distributed around the base plate 108 in FIG. 2, it will be understood that other configurations and numbers of bearings 124 can also be used and are encompassed within the scope of the present invention. It is preferred, however, that the contact points of the bearings 124 collectively form a substantially circular relationship.

Figure 4:
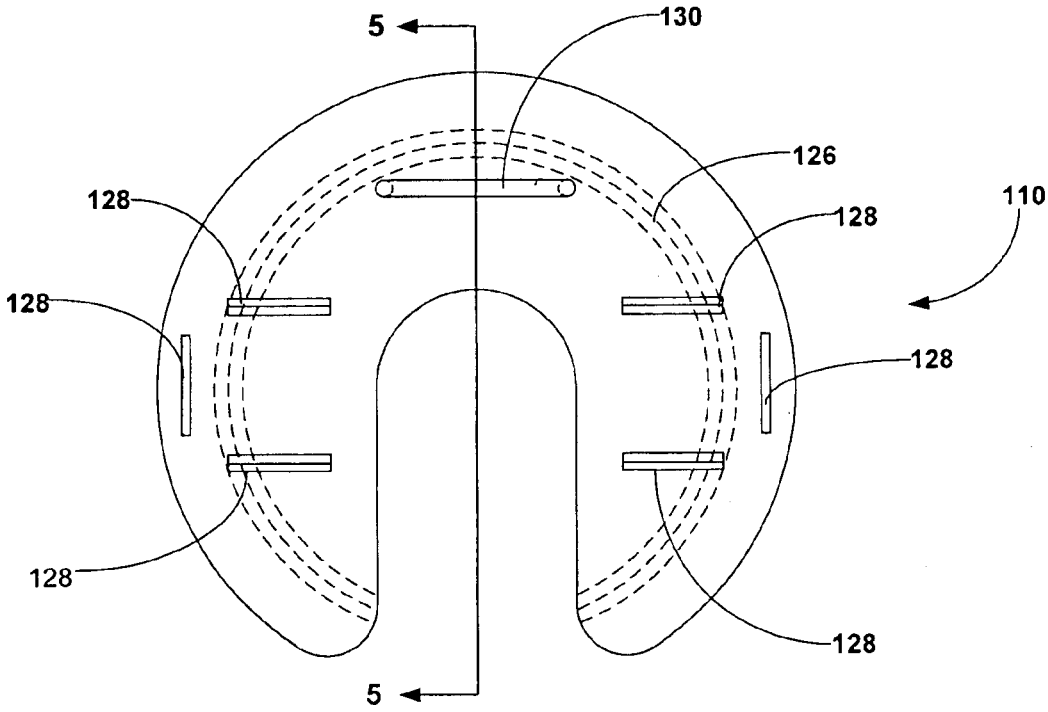
FIG. 4 is a top plan view of the turntable of the rotating jack plate assembly of FIG. 1.
Figure 5:
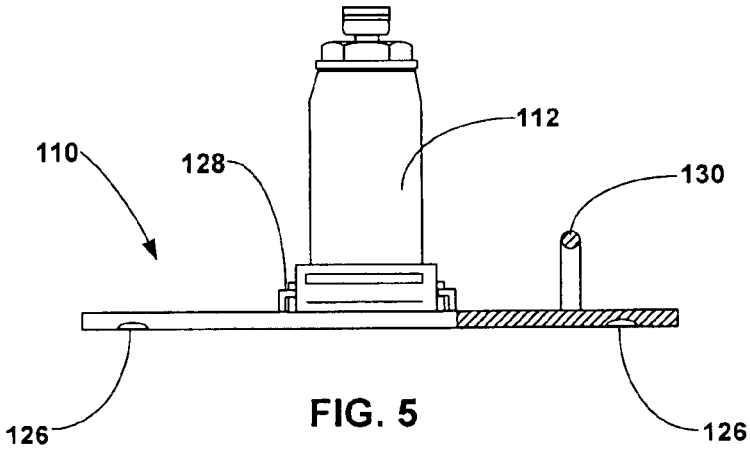
FIG. 5 is a side cross sectional view of the turntable of FIG. 4.

Referring to FIGS. 4 and 5, shown therein is the turntable 110 constructed in accordance with a preferred embodiment of the present invention. Like the base plate 108, the turntable 110 resembles a truncated tube shape and has outer and inner diameters nominally the same as the base plate 108. Although not necessary, a second removable gate (not shown) similar in form and function to the gate 118, can be used with the turntable 110. It is preferred that the turntable 110 be constructed from a strong, rigid material such as steel. In a particularly preferred embodiment, the turntable is constructed from a lighter weight metal or metal alloy that exhibits resistance to deformation, such as aluminum.

The bottom side of the turntable 110 includes a circular track or "race" 126 that is configured to engage the bearings 124 of the base plate 108. In this way, the weight of the turntable 110 is transferred to the base plate 108 through the bearings 124. The bearings 124 allow the turntable 110 to freely rotate with respect to the base plate 108. It will be understood that, if a second removable gate is used with the turntable 110, the second gate should not interfere with the rotary movement of the turntable 110.

The turntable 110 also includes at least one set of mounting brackets 128 that are configured to retain the jack 112. Because two jacks 112 are presently preferred, two sets of mounting brackets 128 are shown in FIG. 4. As shown in FIG. 5, each set of mounting brackets 128 should retain the horizontal and vertical movement of the jack 112 while permitting the removal of the jack 112 if necessary.

The turntable 110 can also include a handle 130 that can be used by an operator to rotate the turntable 110. Although manual operation is presently preferred for its cost effectiveness, mechanized rotation of the turntable is also contemplated as an alternate embodiment of the present invention. For mechanized movement, any number of motor and transmission combinations can be applied to the base plate 108 and turntable 110. For example, a simple rack and pinion combination could be used to rotate the turntable 110 with respect to the base plate 108.

The jack 112 is preferably actuated through application of hydraulic fluid under pressure. For most applications, the jack 112 should be rated to at least 12,000 pounds. Heavier or lighter capacity jacks may be desirable for some applications. Although hydraulic actuation is presently preferred, it will be understood that other lifting mechanisms, such as air jacks, slides and screws of varying capacity could also be used to provide vertical movement. It will also be understood that the operation of the jack 112 can be automated or manually controlled. If more than one jack 112 is used, synchronous operation of the jacks 112 can be accomplished through common valving or automated controls. It will be understood that, as used herein, the term "jack" refers broadly to all lifting mechanisms unless otherwise specified.

Figure 6:
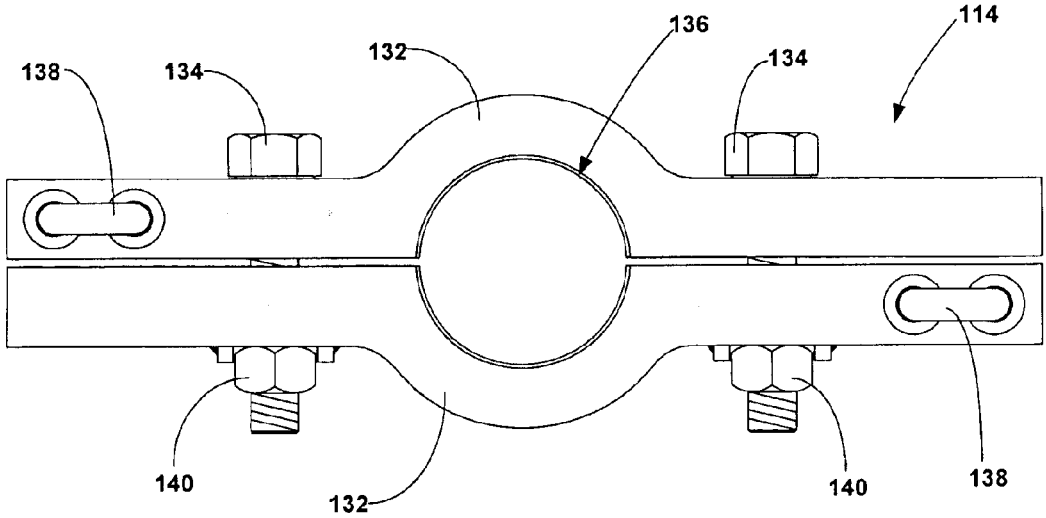
FIG. 6 is a top view of the load collar of the rotating jack plate assembly of FIG. 1.
Figure 7:
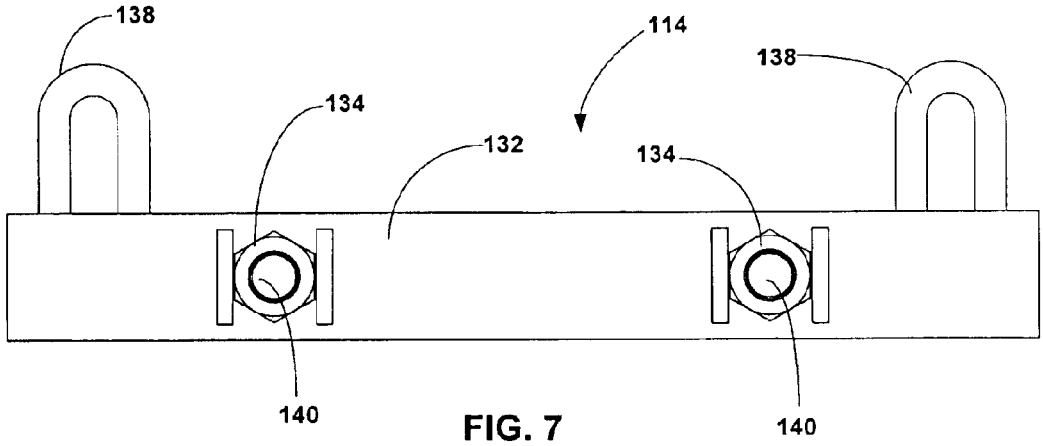
FIG. 7 is a side elevational view of the load collar of FIG. 6.

Turning to FIGS. 6 and 7, shown therein are top plan and side elevational views, respectively, of the load collar 114. The load collar 114 preferably includes two opposing cross-members 132 that are fastened together by a plurality of adjustment bolts 134. Both cross members 132 include a semi-circular hole that combine to form a load collar throat 136 when the cross members 132 are fastened together. Each cross-member 132 also includes a shackle 138 that can be used to connect the load collar 114 to a crane or hoist. It is preferred that the load collar 114 be constructed from a rigid and durable material, such as steel.

The dimensions of the throat 136 can be changed to accommodate various sizes of well string 106 by manipulating the adjustment bolts 134. The adjustment bolts 134 are preferably used in combination with lock-nuts 140. In this way, the adjustment bolts 134 can be tightened or loosened without using an additional tool to hold the lock-nuts 140 stationary. As the dimensions of the load collar throat 136 change, it may be desirable to position spacers between the cross members 132.

Although the load collar throat 136 can impart a compressive force around a portion of the well string 106, it will be understood that the majority of the weight of the well string 106 is unloaded on the top surface of the cross members 132. In many cases, the well string 106 includes an external flange 142 (see FIG. 1) that transfers weight to the load collar 114. It is preferred that the flange 142 have a larger diameter than the load collar throat 136.

Referring back to FIG. 1, depicted therein is a presently preferred method of positioning the well string 106 during assembly through use of the rotating jack plate assembly 100. Although the well string 106 may include any number and variety of downhole tools and equipment, for the purposes of this disclosure, the well string 106 includes a lower section 144 and an adjacent upper section 146.

At the outset, the rotating jack plate assembly 100 is assembled by placing the base plate 108 in a position adjacent the wellhead 102 or intermediate support structure. The turntable 110 is then placed on the base plate 108 such that the bearings 124 are located in the race 126. The jacks 112 are then secured in position on top of the turntable 110 and the load collar 114 is connected to the top ends of the jacks 112. If necessary, the jacks 112 are then connected to a hydraulic pressure-generating source.

Once the rotating jack plate assembly 100 is assembled, a crane or hoist vertically inserts the lower section 144 of the well string 106 into the rotating jack plate assembly 100. Once the lower section 144 is in position, the load collar 114 is tightened to support the weight of the lower section 144. Depending on length, the bottom of the lower section 144 can extend through the wellhead 102 into the well 104. As shown in FIG. 1, the top of the lower section 144 preferably extends above the rotating jack plate assembly 100 to facilitate attachment to the upper section 146. In some applications, it may be desirable to install the load collar 114 after the lower section 144 is laterally contained within the base plate 108 and turntable 110. In most instances, it will not be necessary to remove the gate member 118 from the base plate 110 during the vertical insertion of the well string 106.

The upper section 146 is typically moved into position above the lower section 144 by a crane or hoist (not shown). Unlike the prior art method of assembly, the upper section 146 is not rotated into alignment and lowered onto the lower section 144. Instead, the upper section 146 is preferably held motionless while suspended from the crane or hoist. To align the lower section 144 with the upper section 146, the operator rotates the turntable 110 and the lower section 144 to the desired rotational position. After aligning the lower section 144 with the upper section 146, the lower section 144 is raised into contact with the upper section 146 by applying pressurized hydraulic fluid to the jacks 112. When the lower and upper sections 144, 146 are fitted together, the connection is secured with fasteners, such as 148.

Once secured, the crane or hoist is used to support the combined weight of the lower and upper sections 144, 146. At this time, the pressure of the hydraulic fluid applied to the jacks 112 can be reduced. The load collar 114 can be loosened or removed to allow the passage of the lower and upper sections 144, 146 through the rotating jack plate assembly 100. If a third section will be added to the well string 106, the load collar 114 can be installed in the appropriate position around the upper section 146 and the connection and positioning processes discussed above are repeated.

In some cases, it may be desirable to remove all or part of the rotating jack plate assembly 100 while positioned around the well string 106. After transferring the weight of the well string from the rotating jack plate assembly 100 to the crane or hoist, the load collar 114 can be loosened and removed. Next, the jacks 112 can be disconnected from the power source and removed from the turntable 110. The turntable 110 and the base plate 108 can then be removed together, or separately, from the well string 106. If the base plate 108 includes a gate 118, the gate 118 should be unfastened and removed from the main member 116 to allow removal of the base plate 106.

It will also be understood that the rotating jack plate assembly 100 can also be used to disassembly sections of a well string 106 as they are lifted out of the well 104. During the disassembly process, the rotating jack plate assembly 100 can be used to support the well string 106 as adjacent sections are separated. Supporting the well string 106 with the rotating jack plate assembly 100 facilitates the removal of fasteners, such as fasteners 148, by cooperating with a crane or hoist to optimally control the force transferred through the fasteners, such as 148, during the separation operation.

It is clear that the present invention is well adapted to carry out its objectives and attain the ends and advantages mentioned above as well as those inherent therein. While presently preferred embodiments of the invention have been described in varying detail for purposes of disclosure, it will be understood that numerous changes may be made which will readily suggest themselves to those skilled in the art and which are encompassed within the spirit of the invention disclosed herein and in the appended claims and drawings.

It is claimed:

1. An apparatus for positioning a section of a well string, the apparatus comprising:

a base plate;

a turntable supported by the base plate, wherein the turntable is configured to rotate with respect to the base plate;

a jack assembly supported by the turntable; and a load collar supported by the jack assembly, wherein the load collar is configured to support the section of the well string.

2. The apparatus of claim 1, wherein the base plate comprises a plurality of bearings.

3. The apparatus of claim 2, wherein the bearings are ball-and-socket bearings.

4. The apparatus of claim 3, wherein the turntable includes a race that is configured to engage the bearings.

5. The apparatus of claim 1, wherein the turntable includes a handle for manually rotating the turntable.

6. The apparatus of claim 1, wherein the turntable includes a mechanism for motorized movement.

7. The apparatus of claim 1, wherein the base plate includes a main member and a removable gate.

8. The apparatus of claim 1, wherein the load collar includes a load collar throat.

9. The apparatus of claim 8, wherein the load collar includes an adjustment bolt wherein the load collar throat can be adjusted through manipulation of the adjustment bolt.

10. The apparatus of claim 1, wherein the load collar includes a shackle.

11. An apparatus for positioning a section of a well string during deployment into a well, the apparatus comprising:

a base plate;

a turntable supported by the base plate, wherein the turntable is configured to rotate with respect to the base plate;

a jack assembly supported by the turntable; and a load collar supported by the jack assembly, wherein the load collar is configured to support the section of the well string.

12. The apparatus of claim 11, wherein the base plate comprises a plurality of bearings.

13. The apparatus of claim 12, wherein the turntable includes a race that is configured to engage the bearings.

14. The apparatus of claim 13, wherein the base plate includes a main member and a removable gate.

15. A method for positioning a section of a well string, wherein the section of well string has a rotational position and a vertical position, the method comprising:

supporting the section of well string with a rotating jack plate assembly, wherein the step of supporting the section of well string further includes:

supporting the section of well string with a load collar;

supporting the load collar with a jack; and supporting the jack with a turntable;

rotating the section of well string with the rotating jack plate assembly to adjust the rotational position; and adjusting the vertical position of the section of well string with the rotating jack plate assembly to control the vertical position.

16. The method of claim 15, wherein the step of supporting the section of well string further includes supporting the turntable with a base plate.

17. The method of claim 16, wherein the step of supporting the section of well string includes rotatably supporting the turntable on the base plate.

* * * * *